US006040750A

United States Patent [19]

Pfab

[11] Patent Number: 6,040,750

[45] Date of Patent: Mar. 21, 2000

[54] ELECTROMAGNETIC SWITCHING DEVICE

[75] Inventor: Hans Pfab, Hahnbach, Germany

[73] Assignee: Siemens Aktiengesellschaft, Munich, Germany

[21] Appl. No.: 09/308,546

[22] PCT Filed: Nov. 7, 1997

[86] PCT No.: PCT/DE97/02603

§ 371 Date: May 20, 1999

§ 102(e) Date: May 20, 1999

[87] PCT Pub. No.: WO98/22966

PCT Pub. Date: May 28, 1998

[30] Foreign Application Priority Data

Nov. 20, 1996 [DE] Germany ..... 196 48 053

[51] Int. Cl.[7] ..... H01H 7/16

[52] U.S. Cl. ..... 335/156; 335/131; 335/132; 335/270; 335/274

[58] Field of Search ..... 335/131, 132, 335/156, 270, 274

[56] References Cited

U.S. PATENT DOCUMENTS 3,060,355 10/1962 Kruzic .

FOREIGN PATENT DOCUMENTS 0 224 081 6/1987 European Pat. Off. .
0 358 050 3/1990 European Pat. Off. .
88 11 206 10/1988 Germany .
89 15 089 11/1990 Germany .

*Primary Examiner*—Lincoln Donovan
*Assistant Examiner*—Raymond Barrera
*Attorney, Agent, or Firm*—Kenyon & Kenyon

[57] ABSTRACT

A switching device is provided which includes a magnet system having a yoke which is elastically mounted by means of a volute spring. The volute spring permits the yoke to be displaced as far as closure of the magnet system. As a result, it is possible to prevent current overloading of the magnet system coil in the case of a welded break contact of the switching device.

2 Claims, 2 Drawing Sheets

ELECTROMAGNETIC SWITCHING DEVICE

FIELD OF THE INVENTION

The present invention relates to an electromagnetic switching device including a magnet system comprising an armature and a yoke. The switching device further includes movable contact parts which are held in a movable contact carrier and form break contacts and make contacts with fixed contact parts. The yoke is, elastically suspended in the closing direction of the magnet system and, in the off position, and at a spacing w from the armature.

BACKGROUND INFORMATION

A switching device of the generic type is described in EP 0 358 050. Here, the contact carrier is elastically connected to the armature in such a way that the armature can be moved further without actuating the make contacts in the case of a welded break contact. The magnet system has a yoke which is suspended elastically in the closing direction of the magnet system. This elastic suspension, the elastic connection between the armature and the contact carrier and the elasticity of the movable contact parts are matched to one another in such a way that in the case of a welded break contact and a closed magnet system, the paths of resilience of armature and yoke are approximately the same size. In this way, upon welding of break contacts, the magnet system is closed in order to prevent the magnet coil from burning out. The armature is elastically connected to the contact carrier via a relatively long leaf spring. However, this requires a correspondingly large space in the housing of the switching device.

SUMMARY

It is an object of the present invention to create an electromagnetic switching device by means of which the conditions for positive-action contacts are satisfied in a simple way in accordance with the regulations of the professional association in the event of a malfunction.

The object is achieved by the elastic suspension of the yoke which permits a movement of the yoke as far as closure of the magnet system after the magnet system has been switched on in the case of a welded break contact. The elastic mounting is implemented using a volute spring inserted between the yoke and a coil form. The maximum resilience x of the volute spring in the OFF position is at least as large as the spacing w reduced by the break contact resilience d.

With reference to the overall height of the switching device, it is advantageous when the contact carrier is connected to the armature by a leaf spring in a narrowed-down region, and the narrowed-down region forms, with the housing of the switching device, cavities in which there are situated back-pressure springs acting on the contact carrier.

DETAILED DESCRIPTION

Figure 1:
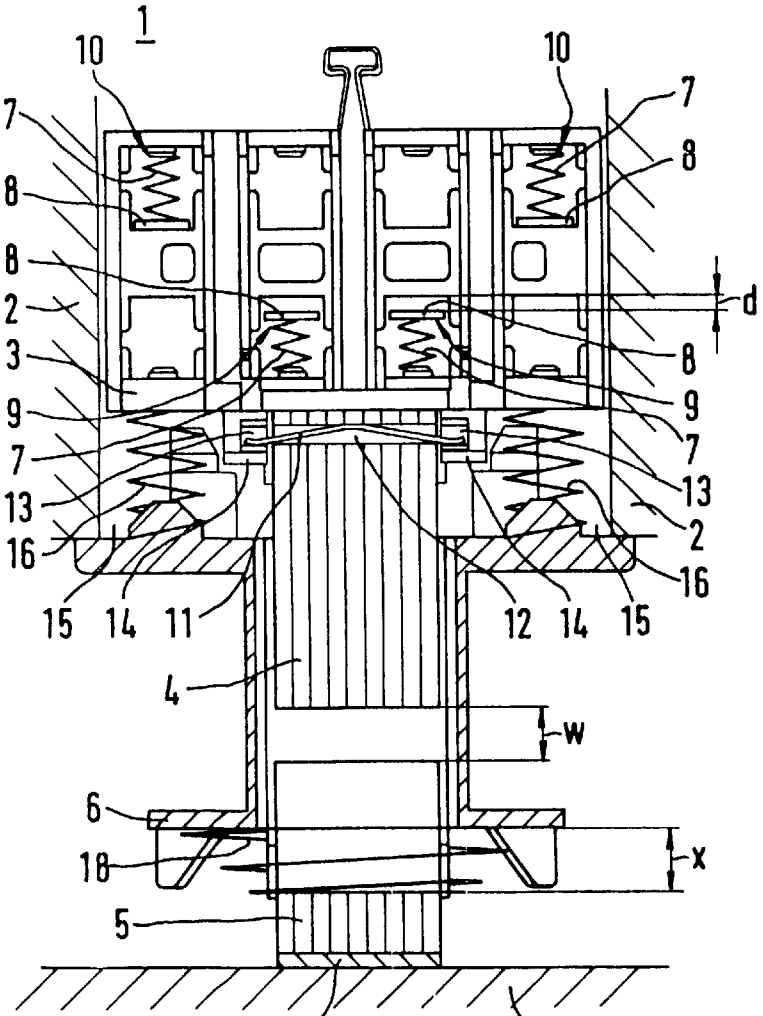
FIG. 1 shows a diagram of the switching device according to the present invention in a sectional side view in the OFF position.

FIG. 1 shows an electromagnetic switching device 1 according to the present invention in the OFF position. The switching device 1 includes a housing 2 (indicated diagrammatically) here, in which a contact carrier 3 is displaceably guided. The electromagnetic switching device 1 also includes a magnet system having an armature 4, a yoke 5 and a coil with a coil form 6. Held in the contact carrier 3 by means of contact press-on springs 7 are contact bridges 8 which form movable contact parts together with contacts (not shown) connected to them. The contact parts form break contacts 9 and make contacts 10 in the conventional manner with fixed contact parts (not shown). The armature 4 and the contact carrier 3 are interconnected via a relatively rigid leaf spring 11. The connection is virtually inelastic, with the result that a relative movement of the armature 4 with respect to the contact carrier 3 in the closing direction is functionally insignificant during operation. The leaf spring 11 is guided through a cutout 12 in the armature 4 and is supported with its ends in recesses 13 in the contact carrier 3. These recesses 13 are located, on the side facing the coil-form 6, in integral formations 14 of the contact carrier 3 which form a narrowed-down region with respect to the remaining width of the contact carrier 3. This forms two cavities 15 towards the housing 2, in which two back-pressure springs 16 are held which hold the contact carrier 3 in the OFF position. The yoke 5 is mounted on the base 17 of the housing 2, and is held by a volute spring 18 supported on the coil form 6. In the OFF position, the armature 4 and the yoke 5 are at a mutual spacing w, i.e., the magnet path. The resilient retention of the yoke 5 permits the latter to move in the closing direction, it being the case that, apart from the spacing w from the armature 4, this movement is limited by the dimension x, i.e., the maximum possible compression of the volute spring 18 as far as the dimension of the unit.

Figure 2:
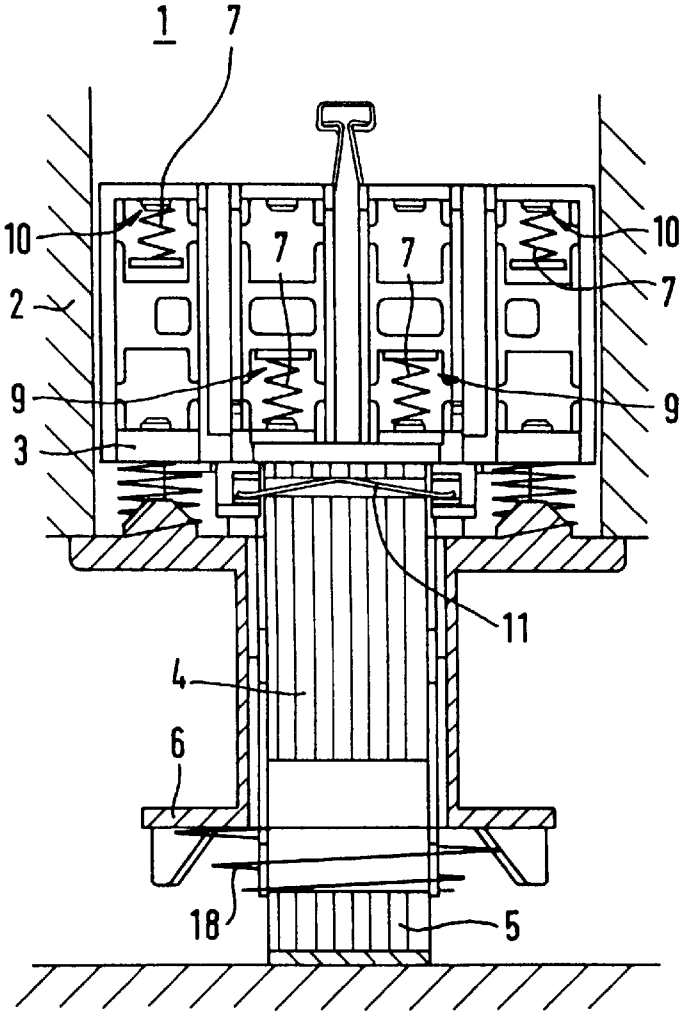
FIG. 2 shows the switching device according to FIG. 1 in the normal ON position.

When the magnet system is excited, the armature 4 moves from the position visible in FIG. 1 into the position represented in FIG. 2. In this process, the contact bridges 8 of the break contacts 9 are separated from the fixed contact parts (not shown in further detail), and the contact bridges 8 of the make contacts 10 come into contact with further fixed contact parts as make contact. The contact press-on springs 7 of the break contacts 9 are relieved in the process, and the contact press-on springs 7 of the make contacts 10 are compressed.

Figure 3:
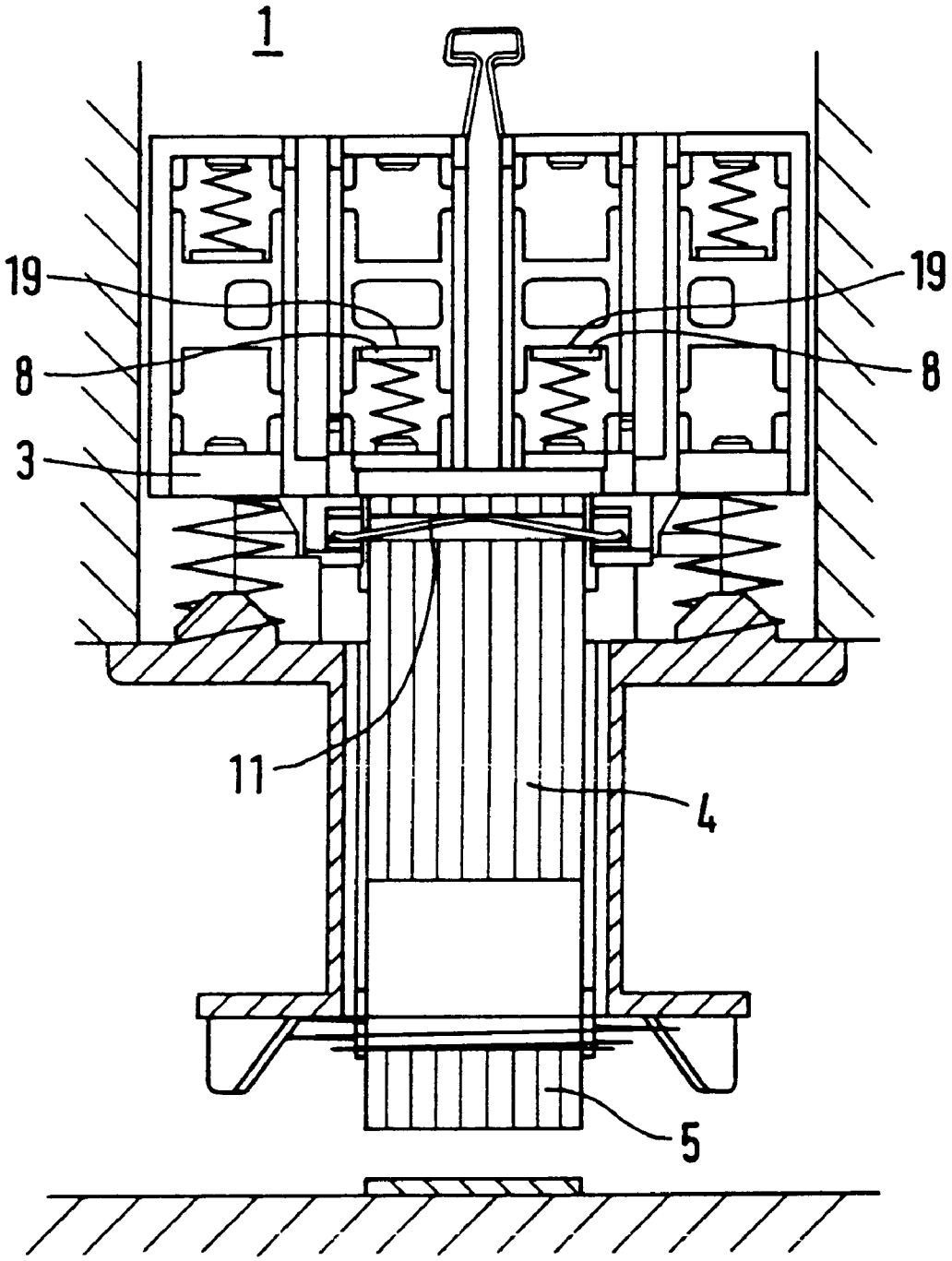
FIG. 3 shows the switching device according to the present invention in the ON position in the case of a welded break contact.

However, if a break contact 9 is welded in the OFF position in accordance with FIG. 1, when the magnet system is excited the armature 4 can move only by the break contact resilience d, as represented in FIG. 3. The contact bridge 8 retained by welding comes into engagement here with the edge 19 of the window in the contact carrier 3 and prevents its further movement. Since the leaf spring 11 is relatively short and inelastic, relative movement possibly still occurring between the armature 4 and the contact carrier 3 in the closing direction is also negligibly small. Burning out of the coil is prevented in this case by virtue of the fact that because of its resilient mounting the yoke 5 can be displaced as far as the closure of the magnet system. This presupposes that the dimension x, i.e., the maximum resilience of the volute spring 16 in the OFF position, is at least as large as the spacing w, or magnet path, reduced by the break contact resilience d, i.e., the condition $$x \geqq w-d$$

is satisfied.

Although the present invention is explained with reference to the embodiment represented in the attached drawing, it should be borne in mind that the aim is not to limit the scope of the present invention only to the embodiment represented, but to include all possible variations, modifications and equivalent arrangements to the extent that they are covered by the contents of the patent claims.

I claim:

1. An electromagnetic switching device, comprising:

movable contact parts held in a movable contact carrier, the movable contact parts forming a break contact and a make contact with fixed contact parts; and a magnet system including an armature and a yoke, the yoke being elastically mounted in a closing direction of the magnet system, and, in an OFF position, the yoke being at a spacing of a magnet path from the armature, the yoke being elastically suspended so as to permit a movement of the yoke as far as closure of the magnet system after the magnet system has been switched on in a case of a welded break contact, the yoke being mounted via a volute spring inserted between the yoke and the coil form, a maximum resilience of the volute spring in the OFF position being at least as large as the spacing of the magnet path reduced by a resilience of the break contact.

2. The electromagnetic switching device according to claim 1, further comprising:

a leaf spring coupling the contact carrier to the armature in a narrowed-down region, the narrowed-down region together with a housing of the switching device forming cavities; and back-pressure springs acting on the movable contact carrier and mounted in the cavities.

* * * * *